United States Patent [19]

Miller

[11] Patent Number: 4,768,928

[45] Date of Patent: Sep. 6, 1988

[54] AXIAL PISTON SWASH PLATE COMPRESSOR MUFFLER ARRANGEMENT

[75] Inventor: Gary T. Miller, E. Amherst, N.Y.

[73] Assignee: General Motors Corporation, Detroit, Mich.

[21] Appl. No.: 148,298

[22] Filed: Jan. 25, 1988

[51] Int. Cl.[4] ..... F04B 27/08; F04B 39/00

[52] U.S. Cl. ..... 417/269; 417/312

[58] Field of Search ..... 417/269, 312, 313

[56] References Cited

U.S. PATENT DOCUMENTS

| | | | |
|---|---|---|---|
| 3,577,891 | 5/1971 | Nemoto et al. | 417/312 X |
| 4,274,813 | 6/1981 | Kishi et al. | 417/312 X |
| 4,347,046 | 8/1982 | Brucken et al. | 417/269 |
| 4,360,321 | 11/1982 | Copp, Jr. et al. | 417/269 |
| 4,544,332 | 10/1985 | Shibuya | 417/312 X |
| 4,583,922 | 4/1986 | Iijima et al. | 417/312 X |
| 4,652,217 | 3/1987 | Shibuya | 417/312 X |

*Primary Examiner*—Carlton R. Croyle
*Assistant Examiner*—Paul F. Neils
*Attorney, Agent, or Firm*—R. L. Phillips

[57] ABSTRACT

An axial piston swash plate refrigerant compressor is provided with a discharge gas baffle and pulse attenuation device that reroutes the discharge gas from one discharge cavity away from the compressor outlet to meet with that from another discharge cavity in an attenuation chamber and thereafter further attenuate the combined discharge prior to delivery to the compressor outlet.

2 Claims, 2 Drawing Sheets

AXIAL PISTON SWASH PLATE COMPRESSOR MUFFLER ARRANGEMENT

TECHNICAL FIELD

This invention relates to axial piston swash plate compressor muffler arrangements and more particularly to attenuating gas pressure pulses at opposite ends of an axial piston swash compressor prior to gas discharge from the compressor.

BACKGROUND OF THE INVENTION

In axial piston swash plate compressors such as used in motor vehicle air conditioning systems, it is common practice to employ a plurality of double-ended pistons that are driven by the swash plate and develop high pressure refrigerant gas in discharge chambers located in opposite ends of the compressor. The nature of this pumping mechanism is such that high pressure pulsations are generated that can cause noise and vibration problems throughout the air conditioning system. For this reason, it is common practice to either add a muffler to the system or incorporate a muffler arrangement directly in the compressor itself.

For example, in the compressor disclosed in U.S. Pat. No. 4,360,321 assigned to the assignee of this invention, there is a muffler arrangement incorporated directly in the compressor structure. In this particular muffler arrangement, one of the discharge cavities opens directly to a single discharge port leading from the compressor and the other discharge cavity (i.e. the remote one) communicates therewith within the compressor by a pair of attenuation chambers that are interconnected by an attenuation passage and ported to the respective discharge cavities. The volumes of the attenuation chambers are substantially equal and the length of the attenuation passage is substantially longer than the corresponding longitudinal dimension of the attenuation chambers so as to attenuate the discharge pulses from the remote discharge cavity and thereby the overall pulse effect to an acceptable output level totally within the structure of the compressor. While such a muffler arrangement has proven generally satisfactory, it has been found that the gas discharged directly from the one discharge cavity to the compressor outlet can cause undesirable noise and vibration disturbances in the air conditioning system under certain conditions.

SUMMARY OF THE PRESENT INVENTION

The present invention offers a simple solution to where a normally directly coupled discharge cavity and compressor discharge outlet presents a potential noise and/or vibration problem. In such an arrangement, the one directly coupled discharge cavity is also open through a port to the attenuation chamber adjacent this cavity. According to the present invention, there is simply provided a discharge gas baffle and pulse attenuation device that includes a flow through pulse attenuation member and fits from within this one discharge cavity in the discharge outlet to block direct gas flow from this cavity to the outlet. The baffle and pulse attenuation device extends from the discharge outlet across the one discharge cavity and through the afore-mentioned port in spaced relationship thereto and toward the one attenuation chamber thereby to act at its exterior as a baffle to cause the gas in the one discharge cavity to all flow into the one attenuation chamber. In the latter, the gas from the one discharge cavity is caused to meet with the gas from the other discharge cavity and flow together out through the attenuation chamber in the baffle and pulse attenuation device and thence out through the discharge outlet thereby fully attenuating the discharge gas pulses from both of the discharge cavities.

An object of the present invention is to provide a new and improved axial piston swash plate compressor muffler arrangement.

Another object is to provide in an axial piston swash plate compressor that generates pulsating high pressure gas in remotely disposed discharge cavities, a gas discharge baffle and pulse attenuation device that diverts the discharge gas in one discharge cavity away from the compressor outlet so as to meet with the gas discharged from another discharge cavity subsequent to pulse attenuation thereof and thence cause the gases from both cavities to flow together through a pulse attenuation chamber in such device to the compressor outlet.

Another object is to provide in an axial piston swash plate compressor having double-ended pistons that discharge high pressure gas into remotely located discharge cavities, a first gas pulse attenuation passage arrangement directing gas from one of the cavities to an attenuation chamber and a gas discharge baffle and pulse attenuation device located in the other discharge cavity that blocks direct connection thereof with a discharge outlet and instead forces communication of the latter discharge cavity with the attenuation chamber and thereafter provides a gas pulse attenuating connection between such attenuation chamber and the discharge outlet to thereby attenuate the gas pressure pulsations from both discharge cavities prior to delivery to the discharge outlet.

These and other objects, advantages and features of the present invention will become more apparent from the following description and drawing in which:

DETAILED DESCRIPTION OF PREFERRED EMBODIMENT

Figure 1:
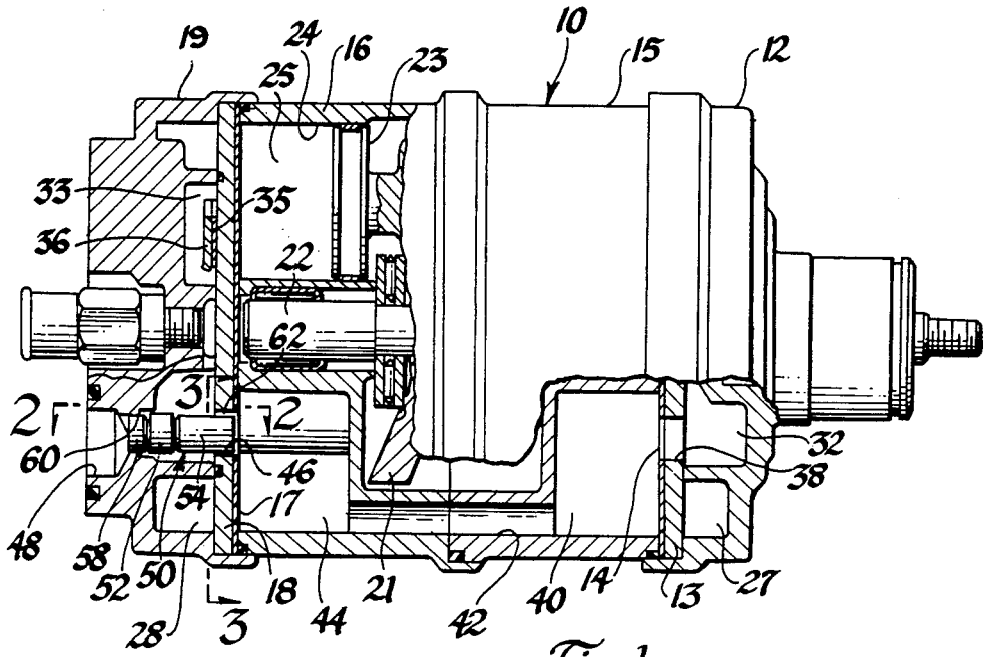
FIG. 1 is a side view with parts broken away of an axial piston swash plate refrigerant compressor for motor vehicle use embodying the present invention.
Figure 2:
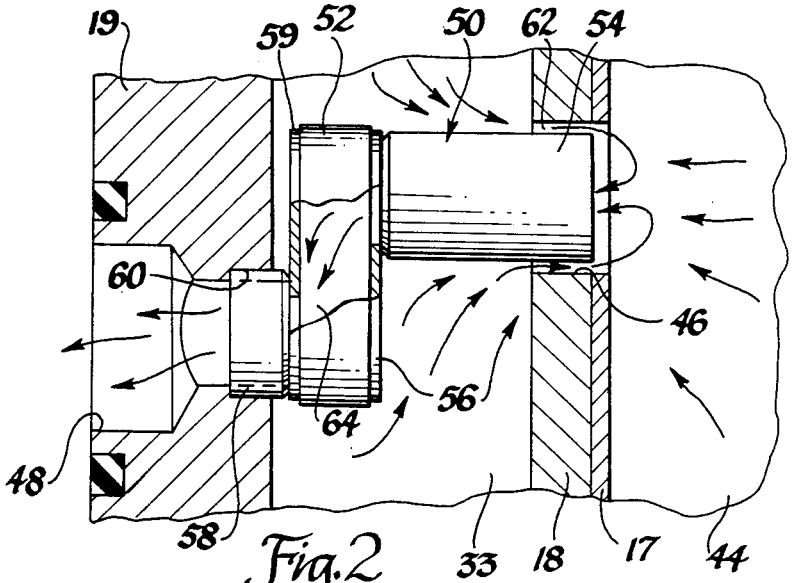
FIG. 2 is an enlarged view taken along the line 2—2 in FIG. 1.
Figure 3:
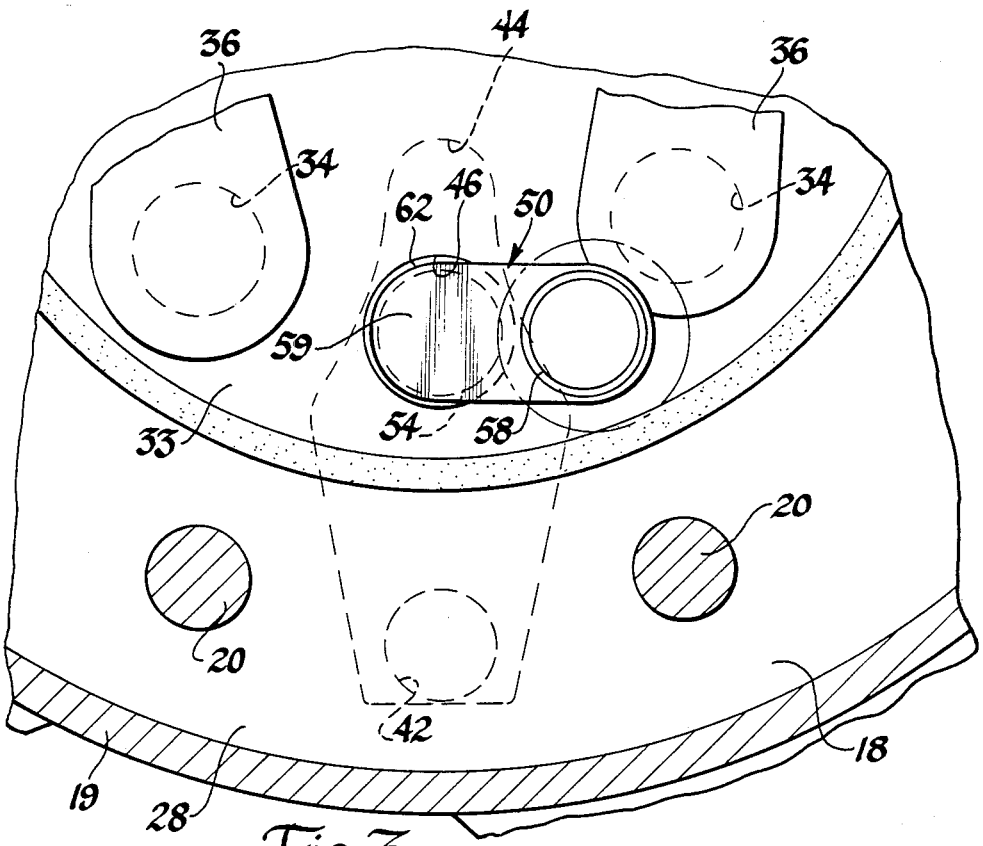
FIG. 3 is an enlarged view taken along the line 3—3 in FIG. 1.

Referring to FIGS. 1-3, the preferred embodiment of the muffler arrangement according to the present invention is shown incorporated in an axial piston swash plate refrigerant compressor like that disclosed in the aforementioned U.S. Pat. No. 4,360,321 which is hereby incorporated by reference. The compressor 10 includes a front head 12, front valve plate 13, front suction valve disk 14, front cylinder block 15, rear suction valve disk 17, rear valve plate 18, rear cylinder block 16 and rear head 19 all arranged in that order and bolted together by bolts 20 of which two are shown in FIG. 3. A swash plate 21 connected to a drive shaft 22 that is rotatably mounted in the compressor operates to drive three double-ended pistons 23 (only one being shown) received in aligned cylinders 24 in the cylinder blocks. The respective piston ends, cylinders and valve plates form working chambers 25 (only one being shown) into which low pressure gaseous refrigerant is drawn on the respective piston's suction stroke from a suction chamber or cavity 27 and 28 in the respective front and rear cylinder heads 12 and 19 via individual suction ports (not shown) and associated suction reed valves (not shown) formed in the respective valve plates 13 and 18 and suction valve disks 14 and 17. The gas in the working chambers is then exhausted on the respective piston's delivery stroke at an elevated pressure to a discharge chamber or cavity 32 or 33 formed in the respective front and rear cylinder heads 12 and 19 via individual discharge ports 34 (only two of which are shown in FIG. 3) formed in the respective valve plates and associated individual reed valves 35 mounted together with retainers 36 on these plates (see FIGS. 1 and 3).

The high pressure gas thus delivered to the front discharge cavity 32 is directed through a port 38 in the front valve plate to a first gas pulse attenuation chamber 40 from which it then passes through an elongated gas pulse attenuation passage 42 to a second gas attenuation chamber 44. Heretofore, the latter chamber was normally connected by a port 46 in the rear valve plate to the rear discharge cavity 33 where the gas from both the front and rear working chambers would then be joined and discharged out a discharge port 48 in the rear head into the air conditioning system. The compressor structure thus far described is like that disclosed in the afore-mentioned U.S. Pat. No. 4,360,321 to which reference is made for a more detailed understanding.

The preferred embodiment of the present invention is incorporated in the above compressor structure and comprises a baffle and pulse attenuation device 50 formed of an oval canister 52 having an inlet pipe 54 extending from one flat side 56 thereof and an outlet pipe 58 of substantially shorter length extending from the opposite flat side 59 of the canister at an end of the canister opposite where the inlet pipe 54 joins therewith. The device 50 is located in the rear discharge cavity 33 and is mounted therein by its outlet pipe 58 having a press fit in a counterbore 60 formed in the normal discharge outlet 48. Thus, direct communication between the rear discharge cavity 33 and the discharge outlet 48 is blocked. The device 50 extends from the discharge outlet 48 across the discharge cavity 33 with its inlet pipe 54 extending through and received in radial spaced relationship the port 46 in the rear valve plate that is open to the rear attenuation chamber 44.

As a result, the high pressure gas from the front discharge cavity 32 is directed as before through the front attenuation chamber 40 and thence through the attenuation passage 42 to the rear attenuation chamber 44 but now all the high pressure gas in the rear discharge cavity 33 is also forced to flow to the rear attenuation chamber 44 by the exterior baffle effecting configuration of the device 50 wherein such gas passes through the annular space 62 defined by the exterior of the inlet pipe 54 and the cylindrical surface of the port 46. All of the discharge gas thus directed from the front and rear discharge cavities and collected in the one attenuation chamber 44 is then in reaching the compressor outlet 48 forced to flow into the inlet pipe 54 and thereby into a final stage gas pulse attenuation chamber 64 that is defined by the oval canister 52 and exits to the compressor outlet via the outlet pipe 58.

Figure 4:
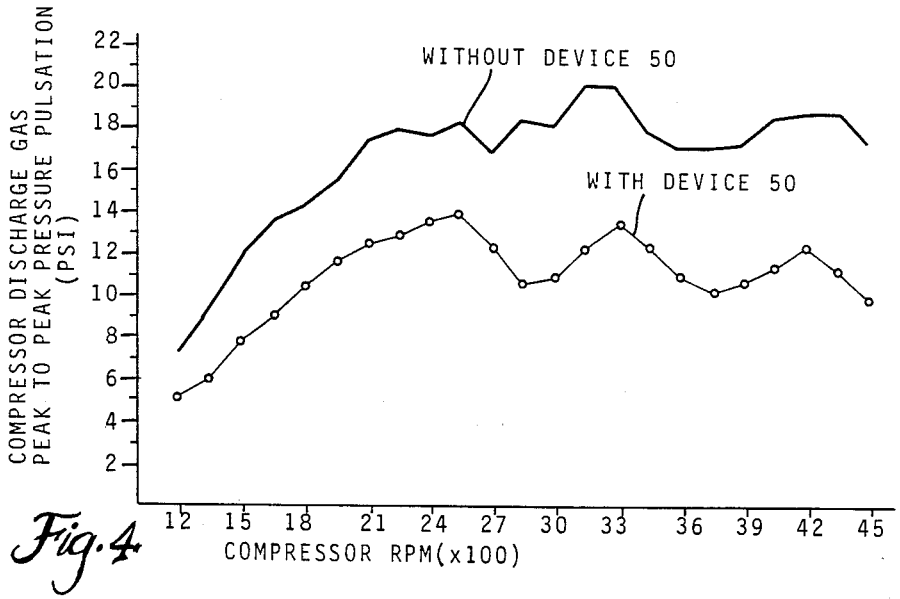
FIG. 4 is a graph showing the peak-to-peak gas pulsations in the compressor in FIG. 1 both before and after the addition of the gas discharge baffle and pulse attenuation device according to the present invention.

The commingling of the gases provided by the baffling of the device and then their expulsion through the additional attenuation chamber provided by the device 50 operates to significantly reduce pressure pulsations and noise from the compressor. For example, there is shown in FIG. 4 the results of tests conducted on the compressor in FIG. 1 with and without the device 50 over a normal speed range. As can be seen, there is a substantial reduction in pressure pulsations provided by the device of the present invention over the entire speed range.

The foregoing description of the preferred embodiment of the invention have been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. An axial piston swash plate compressor having discharge cavities in opposite ends thereof for receiving a gas compressed by and within the compressor, an attenuation chamber adjacent one of said cavities and remote from the other cavity, a first attenuation passage connecting said other cavity to said attenuation chamber, a discharge outlet initially open to said one cavity, a port initially fully openly connecting said one cavity to said attenuation chamber, and discharge gas baffle and pulse attenuation means fitting from within said one cavity in said discharge outlet to block direct gas flow from said one cavity to said discharge outlet, said baffle and pulse attenuation means having a second attenuation chamber therein and extending from said discharge outlet across said one cavity and into said port in spaced relationship thereto thereby to cause gas in said one cavity to be baffled by the exterior of said baffle and pulse attenuation means into said first attenuation chamber to there meet with gas from said other cavity and flow together therewith through said second attenuation chamber to said discharge outlet.

2. An axial piston swash plate compressor having discharge cavities in opposite ends thereof for receiving a gas compressed by and within the compressor, a first attenuation chamber adjacent one of said cavities and remote from the other cavity, an attenuation passage connecting said other cavity to said first attenuation chamber, a discharge outlet, initially open to said one cavity, a port initially fully openly connecting said one cavity to said first attenuation chamber, and discharge gas baffle and pulse attenuation means fitting from within said one cavity by an outlet pipe in said discharge outlet to thereby mount said means in said compressor and block direct gas flow from said one cavity to said discharge outlet, said baffle and pulse attenuation means having a second attenuation chamber therein and extending from said discharge outlet across said one cavity and by an inlet pipe into said port in spaced relationship thereto thereby to cause gas in said one cavity to be baffled by the exterior of said baffle and pulse attenuation means into said first attenuation chamber to there meet with gas from said other cavity and flow together therewith through said second attenuation chamber to said discharge outlet.

* * * * *